United States Patent [19]

Bloos

[11] Patent Number: 4,798,497

[45] Date of Patent: Jan. 17, 1989

[54] DIVING BELT

[76] Inventor: Joseph A. Bloos, 779 N. 14th St., San Jose, Calif. 95112

[21] Appl. No.: 93,767

[22] Filed: Sep. 8, 1987

[51] Int. Cl.[4] ..... B63C 11/02

[52] U.S. Cl. ..... 405/186; 272/119; 405/185

[58] Field of Search ..... 405/186; 273/DIG. 24, 273/DIG. 19; 272/119

[56] References Cited

U.S. PATENT DOCUMENTS

| | | | |
|---|---|---|---|
| 3,039,273 | 6/1962 | Swindell | 405/186 |
| 3,192,723 | 7/1965 | Apperson | 405/186 |
| 3,504,984 | 4/1970 | Bush | 405/186 X |
| 3,851,488 | 12/1974 | Schuler | 405/186 |
| 4,268,917 | 5/1981 | Massey | 272/119 X |
| 4,295,438 | 10/1981 | Porter | 441/9 X |
| 4,498,878 | 2/1985 | Shieh | 405/186 X |

*Primary Examiner*—Dennis L. Taylor
*Attorney, Agent, or Firm*—Jerry T. Kearns

[57] ABSTRACT

A weight belt for use by divers is formed at least partially from a phosphorescent material so that it will be easily visible in a low light environment. The belt may be constructed from a conventional fabric web over which slotted weights are received. The weights may be painted with a phosphorescent paint, or may be encapsulated in a plastic material impregnated with a phosphorescent substance. Alternatively, the diving belt may be formed from a plastic material impregnated with a phosphorescent substance. The slotted weights are slipped over the plastic diving belt and maintain their adjusted position due to frictional engagement of the belt with the slotted weights. The diving belt, when in use, will glow in the dark due to the phosphorescent material, thus enabling divers to locate each other and also preventing loss of the weight belt.

1 Claim, 2 Drawing Sheets

DIVING BELT

BACKGROUND OF THE INVENTION

1. Field of the Invention

The present invention relates to diving belts, and more particularly pertains to a new and improved weight belt for use by divers. A weight belt must be worn by scuba divers to enable them to easily dive beneath the surface of the water. The amount of weight on the belt is selected to offset the natural buoyancy of the diver and the buoyancy of the scuba tanks. In emergency situations, a diver will remove the weight belt in order to easily return to the surface. In this case, the conventional diving belt is difficult to locate. These diving weight belts are relatively expensive and it is desirable to easily locate the diving belt in a low light environment such as that which exists several feet under water and also at night. Also, as most diving is done under the "buddy system", it is desirable to easily locate one's diving partner in low light environments. The present invention provides for a solution of the aforesaid problems through the use of a weight belt treated with a phosphorescent material which will thus glow in the dark.

2. Description of the Prior Art

Various types of diving belts are known in the prior art. A typical example of such a diving belt is to be found in U.S. Pat. No. 3,374,636, which issued to D. Mason on Mar. 26, 1968. This patent discloses a diving belt having a pair of longitudinally extending tubes adapted to be filled with lead shot. In this manner, the weight of the belt may be adjusted by measuring the amount of lead shot added to the tubes. U.S. Pat. No. 4,305,685, which issued to B. Rentfrow on Dec. 15, 1981, discloses a quick release diving belt including a pair of flexible weighted arcuate sections interconnected by a releasable section designed to encircle the waist of a diver with the releasable section disposed at the back of the diver and the arcuate sections terminating in spaced free ends at the front of the waist of the diver to facilitate quick removal. The belt can be tightened by merely pushing on the arcuate sections or can be released by pulling one of the sections at the front of the diver away from the diver's body. U.S. Pat. No. 4,455,718, which issued to D. Finnern on June 26, 1984, discloses a weight strap designed to be mounted circumferentially about a scuba tank. The weight strap is designed to utilize conventional lead diving weights and includes a resilient strap portion designed to provide tension within the strap to tightly maintain the weight strap about the scuba tank. Opposite ends of the strap are provided with a pair of mating, quick release connectors which may be manually separated from one another to selectively release the weight strap from the scuba tank.

While the above mentioned devices are suited for their intended usage, none of these devices provides a diving belt which will glow in the dark. Further, none of the aforesaid diving belts utilize cylindrical slotted weights which frictionally engage a plastic belt impregnated with a phosphorescent material. Additionally, none of the previously mentioned diving belts contemplate the use of diving weights painted with or encapsulated in a phosphorescent material. Inasmuch as the art is relatively crowded with respect to these various types of diving belts, it can be appreciated that there is a continuing need for and interest in improvements to such diving belts, and in this respect, the present invention addresses this need and interest.

SUMMARY OF THE INVENTION

In view of the foregoing disadvantages inherent in the known types of diving belts now present in the prior art, the present invention provides an improved diving belt. As such, the general purpose of the present invention, which will be described subsequently in greater detail, is to provide a new and improved diving belt which has all the advantages of the prior art diving belts and none of the disadvantages.

To attain this, representative embodiments of the concepts of the present invention are illustrated in the drawings and make use of generally cylindrical diving weights which are painted with a phosphorescent material or encapsulated in a plastic material impregnated with a phosphorescent substance. Additionally, the present invention contemplates the use of a plastic diving belt impregnated with a phosphorescent sunbstance. An additional feature of the present invention is the use of elongated generally cylindrical weights, each of which is provided with a slot to receive and frictionally engage a plastic diving belt.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved diving belt which has all the advantages of the prior art diving belts and none of the disadvantages.

It is another object of the present invention to provide a new and improved diving belt which may be easily and efficiently manufactured and marketed.

It is a further object of the present invention to provide a new and improved diving belt which is of a durable and reliable construction.

An even further object of the present invention is to provide a new and improved diving belt which is susceptible of a low cost of manufacture with regard to both materials and labor, and which accordingly is then susceptible of low prices of sale to the consuming public, thereby making such diving belts economically available to the buying public.

Still yet another object of the present invention is to provide a new and improved diving belt which provides in the apparatuses and methods of the prior art some of the advantages thereof, while simultaneously overcoming some of the disadvantages normally associated therewith.

Still another object of the present invention is to provide a new and improved diving belt which will glow in low light environments.

Yet another object of the present invention is to provide a new and improved diving belt which utilizes elongated generally cylindrical slotted weights coated with a phosphorescent material.

Even still another object of the present invention is to provide a new and improved diving belt which utilizes a plastic belt impregnated with a phosphorescent material.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
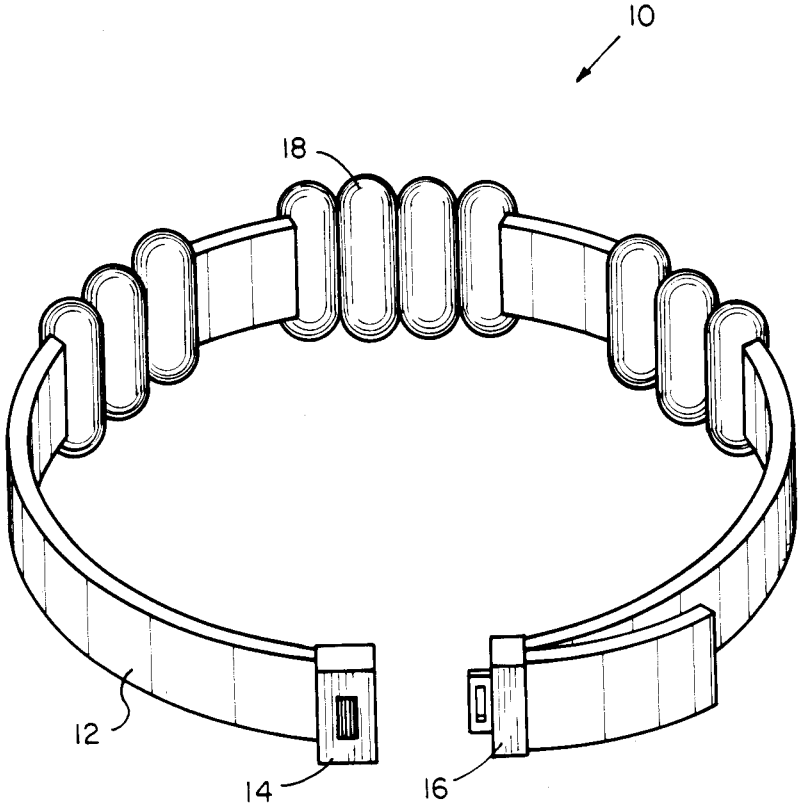
FIG. 1 is a perspective view of a diving belt in accordance with the present invention.

With reference now to the drawings, and in particular to FIG. 1 thereof, a new and improved diving belt embodying the principles and concepts of the present invention and generally designated by the reference numeral 10 will be described.

More specifically, it will be noted that the first embodiment 10 of the invention includes an elongated flexible belt 12. This belt may be either formed as a conventional fabric web type of belt or may be formed from a plastic material impregnated with a phosphorescent substance. In either case, corresponding mating quick release connectors 14 and 16 attach to opposite end portions of the belt. Generally cylindrical slotted weights 18 are slidably received on the belt 12. Frictional engagement of the belt with the sidewalls of the slots is sufficient to maintain the weights 18 in adjusted position. The weights have rounded ends in order to ensure comfort and safety of the diver. Weights 18, when in use with a fabric web type of belt, may be formed from lead and painted with a phosphorescent paint. Alternatively, the weights 18 may be encapsulated in a plastic material impregnated with a phosphorescent substance. Either type of weight may also be utilized with a plastic belt impregnated with a phosphorescent material. A variety of commercially available phosphorescent paints and plastics may be utilized, the specific composition of the materials forming no part of the present invention.

Figure 2:
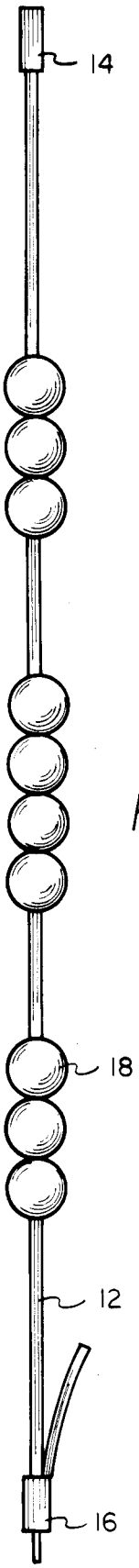
FIG. 2 is a side view of the diving belt in accordance with the present invention.

With reference now to FIG. 2, a side view of the diving belt 10 of the present invention is illustrated in a stretched extended position. It may now be easily understood that the weights 18 may be spaced along the length of the belt 12, to evenly distribute the weight load around the diver's waist.

Figure 3:
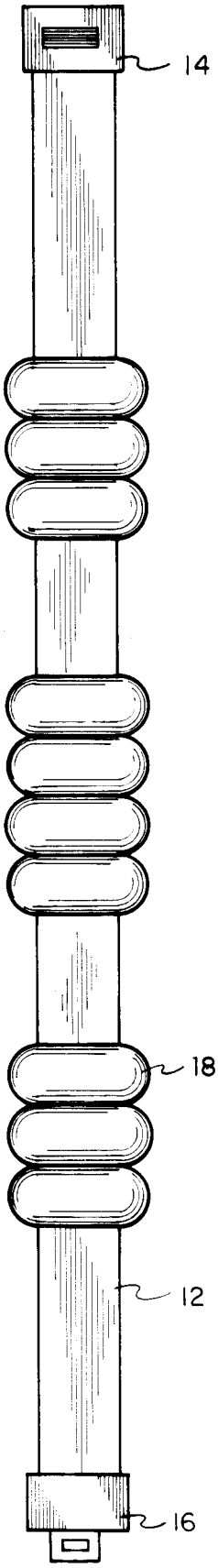
FIG. 3 is a front view of the diving belt of the present invention.

With reference now to FIG. 3, the relative configuration of the weights 18 is apparent. The quick release connectors 14 and 16 are shown at opposite ends of the belt 12, which is in an extended condition.

The manner of usage of the diving belt 10 of the present invention will now be described. Before use, the phosphorescent portions of the diving belt 10 are exposed to intense light. If the dive is to be carried out in the dark, the headlights of a car may be conveniently used as a source of illumination. By exposing the phosphorescent portions of the belt to an intense light source for a few minutes, these portions will glow in the dark for a period of approximately one and a half to two hours. Then, the diving belts are fastened around the waist of the diver utilizing the quick release connectors 14 and 16. In use, the diving belt will now be readily visible for many feet by another diver, or may be easily retrieved if jettisoned in an emergency situation. The phosphorescent diving belt of the present invention may be reused many times, by merely exposing the phosphorescent portions of the belt to an intense light source for a few minutes before each use. This is believed preferable to the use of a battery and light illumination system as the necessity of replacement of batteries and bulbs is avoided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved weight belt, comprising:

an elongated flexible plastic belt impregnated with a phosphorescent material;

cooperating quick release fasteners provided at opposite ends of said belt;

a plurality of weights attached to said belt;

each of said weights comprising a generally cylindrical lead body having hemispherical end portions and provided with a longitudinal slot through which said belt is received;

frictional engagement of said belt in said slots being sufficient to maintain said weights in adjusted position;

and each of said weights encapsulated in a plastic material impregnated with a phosphorescent substance.

* * * * *